United States Patent [19]

Sawafuji

[11] Patent Number: 4,544,805

[45] Date of Patent: Oct. 1, 1985

[54] PLANE SPEAKER

[76] Inventor: Tadashi Sawafuji, No. 9-15, Nishi-Sugamo 1-chome, Toshima-ku, Tokyo, Japan

[21] Appl. No.: 419,378

[22] Filed: Sep. 17, 1982

[30] Foreign Application Priority Data

Sep. 25, 1981 [JP] Japan ..... 56-142775[U]
Sep. 25, 1981 [JP] Japan ..... 56-142776[U]
Dec. 14, 1981 [JP] Japan ..... 56-185989[U]

[51] Int. Cl.[4] ..... H04R 7/02
[52] U.S. Cl. ..... 179/115.5 PV; 181/173
[58] Field of Search ..... 179/115.5 PV, 115.5 ES, 179/115 V, 115.5 VC; 181/161, 164, 173

[56] References Cited

U.S. PATENT DOCUMENTS 1,987,412 1/1935 Neumann ..... 179/115.5 PV
3,636,278 1/1972 Heil ..... 179/115.5 PV
3,699,249 10/1972 Crane ..... 179/115.5 PV
3,829,623 8/1974 Willis ..... 179/115.5 PV
4,056,697 11/1977 Heil ..... 179/115.5 PV
4,276,449 6/1981 Sawafuji ..... 179/115.5 PV
4,354,066 10/1982 Necoechea ..... 179/115.5 PV

FOREIGN PATENT DOCUMENTS 456570 4/1926 Fed. Rep. of Germany ... 179/115.5 PV
57-65996 4/1982 Japan ..... 179/115.5 PV

*Primary Examiner*—Thomas W. Brown
*Assistant Examiner*—L. C. Schroeder
*Attorney, Agent, or Firm*—Fulbright & Jaworski

[57] ABSTRACT

A plane speaker comprises a frame having an opening; a diaphragm facing said opening and having secured its peripheral edge portion to the frame; an actuating plate attached perpendicularly to the back of said diaphragm; a coil mounted on the surface of said actuating plate; and magnets attached to the frame opposite to each other in relation to said coil.

1 Claim, 10 Drawing Figures

PLANE SPEAKER

BACKGROUND OF THE INVENTION

This invention relates to a plane speaker.

In comparison with the conventional corn speaker constructed so that a voice coil is disposed at the rear edge part of a corn-shaped diaphragm and actuated by application of magnetic field generated by a cylindrical magnet, the so-called plane speaker constructed so that voice is emitted by a before and behind reciprocal displacement of a flat diaphragm is advantageous in that it is usable for instance as car speaker and the like because its whole thickness can be made compact in the direction of vibration. However, the conventional plane speaker is disadvantageous in that the means for actuating the diaphragm is complicated in construction and consequently the production cost becomes high; localized vibration is caused on the diaphragm so that it becomes difficult to obtain a high quality voice extending through the whole frequency range; and the like.

SUMMARY OF THE INVENTION

It is an object of this invention to provide a plane speaker capable of eliminating the inherent drawbacks in the above prior art plane speaker as well as exhibiting its inherent advantages as they are, that is a plane speaker capable of simplifying the construction of the means for actuating the diaphragm and reducing the production cost.

According to this invention, the aforesaid object can be achieved by providing a plane speaker comprising a frame having an opening; a diaphragm facing said opening and having secured its peripheral edge portion to the frame; an actuating plate attached perpendicularly to the back of said diaphragm; a coil mounted on the surface of said actuating plate; and magnets attached to the frame opposite to each other in relation to said coil.

According to this invention, furthermore, the aforesaid object can be achieved more profitably by providing a modification in which a coil is formed of a printed wiring printed on a diaphragm; said diaphragm is formed by folding a piece of flexible plate zigzag repeatedly; further both a diaphragm and an actuating plate are formed on a piece of flexible plate; and this flexible plate is folded onesidedly at regular intervals to form the actuating plate by adjacent longitudinal wall portions, the remainder forming the flat diaphragm.

It is another object of this invention to provide a plane speaker capable of preventing the occurrence of localized vibration on a diaphragm efficiently and obtaining a high quality voice extending through the whole frequency range.

According to this invention, the aforesaid object can be achieved by providing a modification in which a wave-like portion is formed on the upper surface of a piece of flexible plate.

It is a further object of this invention to provide a plane speaker designed so that leakage of magnetic flux to the outside is little, a high magnetic flux density-magnetic line of force is applied to a coil, and further the same directional driving force is applied to every place of the coil without causing any possibility that the reverse directional driving force is generated depending on places, whereby the diaphragm can be actuated efficiently with a small amount of electric current.

According to this invention, the aforesaid object can be achieved by providing a modification in which a coil is provided on both sides of a diaphragm, a pair of magnets are disposed on both sides of said diaphragm interposed therebetween, both magnets each has polarities on the upper and lower parts respectively, and the upper parts and lower parts of both magnets confronting in the horizontal direction are different in polarity respectively.

DETAILED DESCRIPTION OF THE INVENTION

Figure 1:
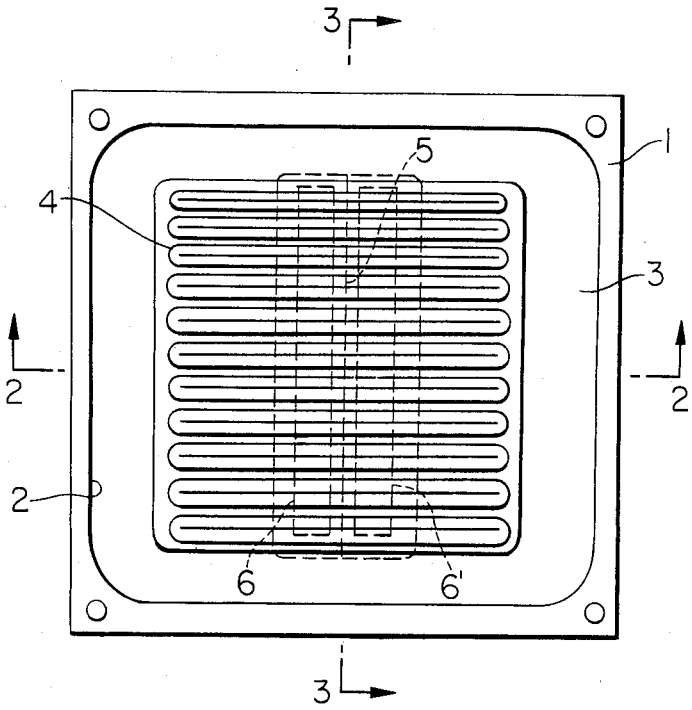
FIG. 1 is a plan view of the first embodiment of the plane speaker according to this invention.
Figure 3:
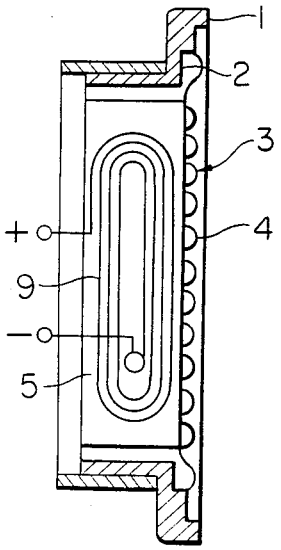
FIG. 3 is a sectional view taken in the direction of the arrows substantially along the lines 3—3 of FIG. 1
Figure 2:
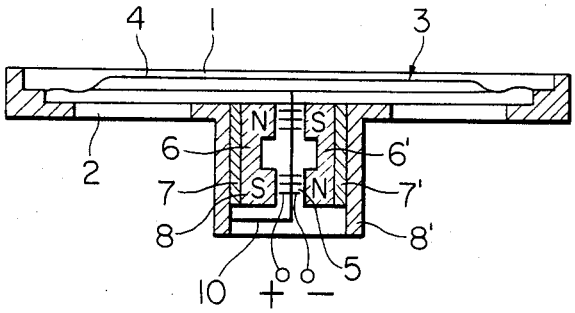
FIG. 2 is a sectional view taken in the direction of the arrows substantially along the lines 2—2 of FIG. 1.

FIGS. 1 to 3 each illustrates the first embodiment of the plane speaker according to this invention.

In these figures, reference numeral 1 denotes a main frame having an opening 2, the peripheral edge of a diaphragm 3 is secured to the circumference of this opening 2, and circular arc cone-shaped projections are formed on this diaphragm 3.

A pair of auxiliary frames 8 and 8' are attached leaving a space therebetween to the middle portion of the back of the frame 1 making a right angle with the projection 4, magnetic materials 7 and 7' are provided on the confronting inner surfaces of said frames 8 and 8' respectively, and a pair of magnets 6 and 6' are mounted in the confronting manner on the surfaces of these magnetic materials 7 and 7'. These magnets 6 and 6' are horizontal horseshoe-shaped, and the upper and lower parts of one magnet are arranged to have the magnetic pole S or N opposite to the magnetic pole N or S of the other confronting magnet.

An actuating plate 5 is disposed so as to locate between both magnets 6 and 6', the upper edge of said actuating plate being attached to the back of the diaphragm 3, the lower edge thereof being supported elastically by a supporting means 10 attached to the auxiliary frame 8. On both sides of the actuating plate 5, as seen from FIG. 3, there is provided an oval spiral coil 9 in the manner of confronting the poles of magnets 6 and 6'.

In the case of aforesaid embodiment, it is preferable that the diaphragm 3 should be made from a film material for instance such as synthetic resin or the like, the projection 4 should be formed by vacuum forming or the like, and the actuating plate 5 should be formed by etching the coil 9 in a printed wiring plate. This makes it possible to manufacture the diaphragm 3 and coil 9 with ease and thus provide them cheaply. However, it is needless to say that the resultant advantages should not be limited thereto alone.

In the operation of the speaker like this, when a signal electric current is applied to the coil 9 of the actuating plate 5, an electromagnetic driving force right-angled to the direction of electric current exerts on the coil 9, according to Fleming's left-hand rule, depending on the intensity of a signal electric current generated in the magnetic field formed by magnets 6 and 6', and consequently the actuating plate 5 vibrates before and behind along the direction of its surface together with the diaphragm 3, whereby a voice is emitted. In the case of this embodiment, there is no possibility that the localized vibration of the diaphragm 3 is caused because projections 4 are formed on the diaphragm 3 in order to stiffen it. Further, leakage of magnetic flux to the outside is very little because a strong magnetic line of force is applied to the magnetic path connecting magnets 6 and 6' mutually, and still further the diaphragm 3 can be actuated efficiently with a small amount of electric current because a high magnetic flux density-magnetic line of force is applied to the coil 9 of the actuating plate 5.

Figure 4:
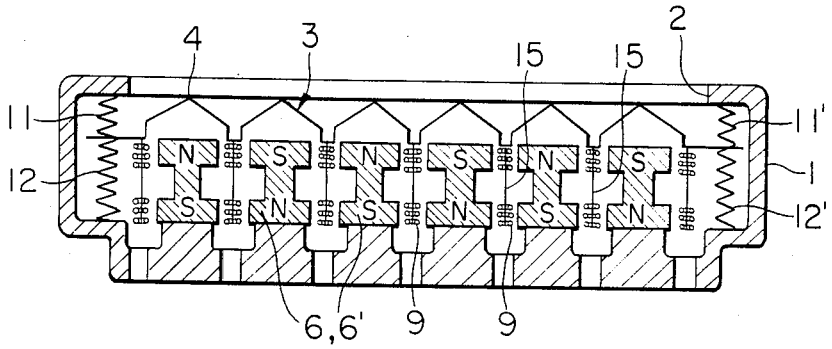
FIG. 4 is a longitudinal elevation of the second embodiment of the plane speaker according to this invention.
Figure 5:
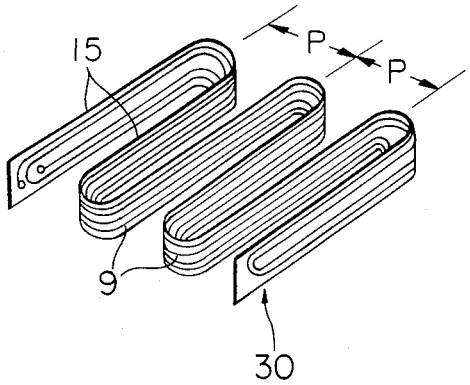
FIG. 5 is a slant view of the diaphragm and coil of the plane speaker illustrated in FIG. 4.
Figure 6:
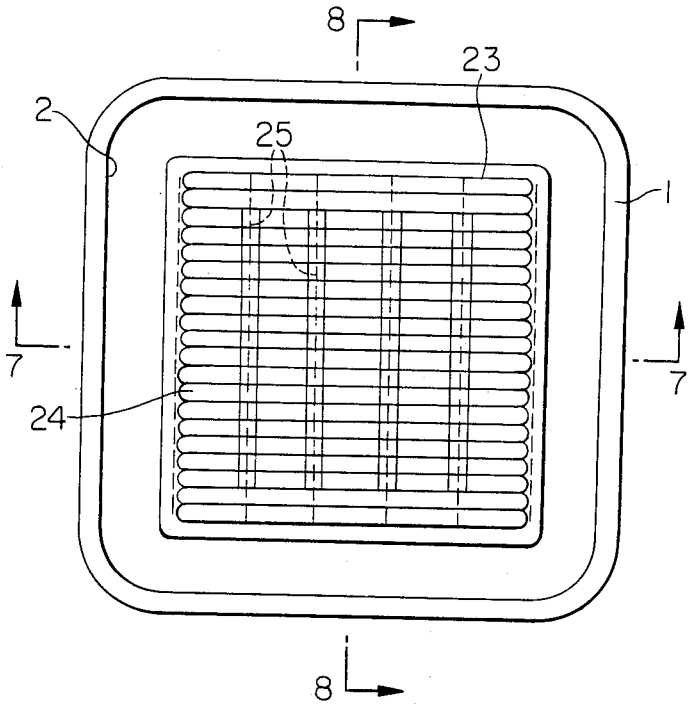
FIG. 6 is a plan view illustrating the third embodiment of the plane speaker according to this invention.
Figure 8:
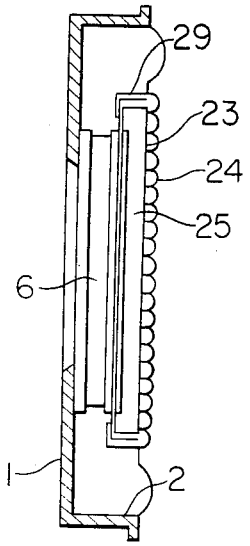
FIG. 8 is a sectional view taken in the direction of the arrows substantially along the lines 8—8 of FIG. 6.
Figure 7:
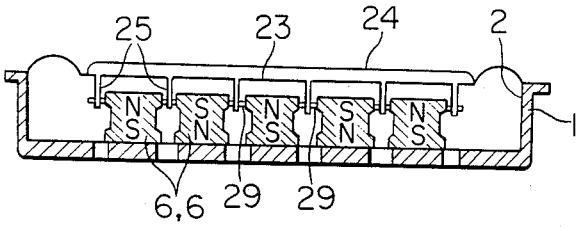
FIG. 7 is a sectional view taken in the direction of the arrows substantially along the lines 7—7 of FIG. 6.
Figure 9:
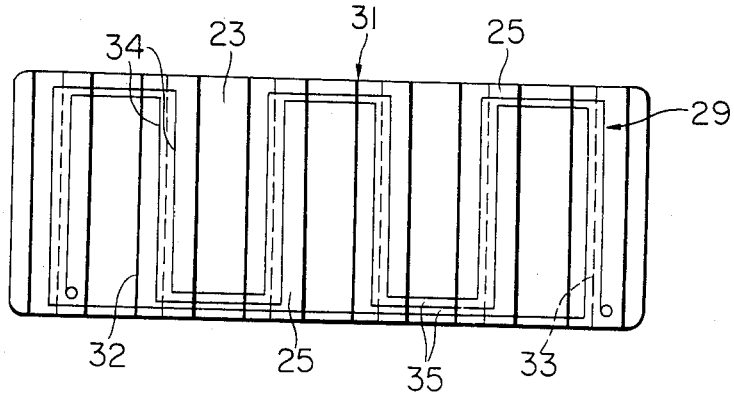
FIG. 9 is a developed plan view of the diaphragm, actuating plate and coil illustrated in FIG. 6.

In FIGS. 4 and 5 there is shown the second embodiment of the plane speaker according to this invention. In this connection, it is to be noted that the same symbols as those in the first embodiment will be affixed to the same parts of this embodiment as those in the first embodiment, and explanation will be made mainly on the different parts.

In this embodiment, the diaphragm 3 takes the shape of a suspension edge formed by supporting the peripheral edge of the diaphragm elastically with resilient supporting means 11, 11'; 12, 12', a plural number of actuating plates 15 are provided, and plural sets of magnets 6, 6' are installed with these actuating plates 15 interposed therebetween.

This actuating plate 15, as is evident from FIG. 5, is made of a piece of flexible web 30 that has on both sides continuous coils 9 as shown in the first embodiment, and the same is longitudinally folded repeatedly leaving a fixed pitch therebetween into the zigzag shape as well as one side edge thereof is attached to the level portion of the back of the diaphragm 3 as shown in FIG. 4. Accordingly, this embodiment is different from the first embodiment in that the direction of the actuating plate 5 becomes parallel to that of the projection 4.

Although the vibration operation in this embodiment is effected according to the exactly same principle as the first embodiment, this embodiment permits the so-called over-all vibration wherein the actuating plate 5 vibrates covering substantially the whole back surface of the diaphragm 3, whereby a higher quality voice can be obtained.

FIGS. 7 to 10 each shows the third embodiment of the plane speaker according to this invention. This embodiment will be explained in the same manner as the second embodiment.

In this embodiment, a diaphragm 23 and an actuating plate 25 are made of a flexible web 31 such as Mylar film or the like to define horizontal top folding lines 32 (shown with solid lines in FIG. 9) leaving a fixed distance therebetween. In the centers of alternate sections separated by these folding lines 32 there are defined bottom folding lines 33 (shown with dotted lines in FIG. 9). Transverse coil portions 34 are disposed on both sides of this folding line 33 as well as parallel thereto. This coil portion 34 is connected alternately with its adjacent coil portion 34 by means of a vertical coil portion 35 making a right angle thereto. Thus, there is prepared a zigzag-shaped whole coil 29.

When folding the side portions of this flexible web 31 adjacent to the bottom folding lines 33 downward, the actuating plate 25 is formed by these folded portions and the diaphragm 23 is formed of the remaining top plate portions defined between top folding lines 32.

In this connection, it is to be noted that in the case of this embodiment the projection 4 used in the first embodiment for the purpose of preventing the occurrence of localized vibration is not provided on the diaphragm 25, and in stead of this a plate with projection 24 is attached to the diaphragm 25. However, it is applicable to this embodiment to fold the diaphragm 25 as done in the second embodiment without attaching said plate with projection to the diaphragm.

Figure 10:
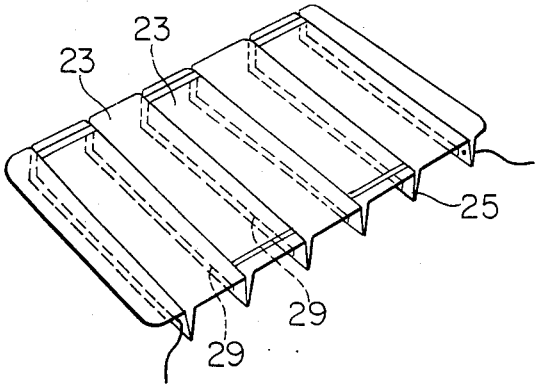
FIG. 10 is a slant view of the assembly of diaphragm, actuating plate and coil illustrated in FIG. 9, said actuating plate being formed by folding the diaphragm.

Although this embodiment is operated in the same manner as the second embodiment, if the coil 29 has previously been printed at the predetermined place of the flexible web 31 and the same web 31 is folded in the manner as aforesaid, the product becomes easy to manufacture and consequently can be provided cheaply because the preparation of diaphragm 23 and actuating plate 25 is finished at a stroke, during which the wiring work is easy and the folding work can be done automatically using a forming machine. Further, there is no necessity of selecting the material for the flexible web 31 strictly because said forming work can be conducted at normal temperatures. On folding, still further, when adjacent transverse coil portions 34 are folded so as to locate on the outside of the actuating plate 25 (on the side opposite to FIG. 10) said coil portions are to be separated from each other by the actuating plate 25 with the result that the occurrence of short trouble may be prevented and further when transverse coil portions 34 are mutually located on the inside of the actuating plate 25 as shown in FIG. 10 the occurrence of short trouble can be prevented likewise by leaving a space therebetween so that the inside surfaces of adjacent actuating plate 25 do not adhere to each other.

The coil 29 is illustrated in the form of two parallel, zigzag lines being identical in the direction of electric supply. However, it is to be understood that even if the direction of electric supply is identical, the number of parallel lines should not be limited to 2, namely may be increased in suitable plural lines such as 4, 6 or the like.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A plane speaker comprises a frame having an opening portion; a plane diaphragm which has its peripheral edge portion secured to said frame facing said opening portion of the frame and has been provided with a number of parallel cone-shaped projections; a folded actuating plate which is formed separately from said diaphragm and attached perpendicularly to the back only of said diaphragm; a coil printed on both surfaces of the actuating plate; and a magnet disposed on the frame oppositely to said coil, said actuating plate made by repeatedly folding a piece of flexible web zigzag in the longitudinal direction and attaching one edge thereof to the back of the diaphragm.

* * * * *